US008444000B2

(12) United States Patent
Bergman et al.

(10) Patent No.: US 8,444,000 B2
(45) Date of Patent: May 21, 2013

(54) ERGONOMIC PAINT ROLLER TRAY WITH END HANDLES

(75) Inventors: Mark W. Bergman, Minnetonka, MN (US); Christopher M. Bergman, Hopkins, MN (US); Matthew V. Leyden, St. Paul, MN (US); Jeffrey B. Waffensmith, North Oaks, MN (US); Jeffrey T. Given, St. Paul, MN (US)

(73) Assignee: Bercom International, LLC, Chanhassen, MN (US)

( * ) Notice: Subject to any disclaimer, the term of this patent is extended or adjusted under 35 U.S.C. 154(b) by 0 days.

(21) Appl. No.: 13/426,358

(22) Filed: Mar. 21, 2012

(65) Prior Publication Data

US 2012/0223085 A1 Sep. 6, 2012

Related U.S. Application Data

(63) Continuation of application No. 12/414,986, filed on Mar. 31, 2009, now Pat. No. 8,162,169.

(60) Provisional application No. 61/127,347, filed on May 12, 2008.

(51) Int. Cl.

| | |
|---|---|
| ***B65D 21/00*** | (2006.01) |
| ***B65D 21/02*** | (2006.01) |
| ***B65D 25/14*** | (2006.01) |
| ***B05C 21/00*** | (2006.01) |

(52) U.S. Cl.
USPC .... 220/570; 220/23.4; 220/23.6; 220/495.02; 220/771; 206/509

(58) Field of Classification Search
USPC ..... 220/23.4, 23.6, 495.02, 570, 608, 220/771; 206/505, 509
See application file for complete search history.

(56) References Cited

U.S. PATENT DOCUMENTS

| | | | |
|---|---|---|---|
| 2,922,176 | A | 1/1960 | Bernhardt |
| 2,950,032 | A | 8/1960 | Willis et al. |
| D193,382 | S | 8/1962 | Goetz |
| 3,157,902 | A | 11/1964 | Hardwick |
| D208,969 | S | 10/1967 | Paxton |
| D211,611 | S | 7/1968 | Fox, Jr. et al. |
| 3,828,389 | A | 8/1974 | Heisler |
| 3,947,135 | A | 3/1976 | Hawk |
| 4,023,702 | A | 5/1977 | McKnight |
| 4,445,250 | A | 5/1984 | Seidl |
| D301,785 | S | 6/1989 | Goetz |
| D302,614 | S | 8/1989 | Beatty |
| 5,201,439 | A | 4/1993 | Davies |
| 6,019,241 | A | 2/2000 | Burns |

(Continued)

*Primary Examiner* — Anthony Stashick
*Assistant Examiner* — Madison L Poos
(74) *Attorney, Agent, or Firm* — James L. Young; Westman, Champlin & Kelly, P.A.

(57) ABSTRACT

A paint tray includes a cavity defined by a bottom wall, a first side wall, a second side wall, a first end wall, and a second sloping end wall. Each of the first side wall, second side wall, first end wall, and second sloping end wall inclines upwardly and outwardly from the bottom wall. The cavity terminates at a top edge. The paint tray also includes a top tray rim adjacent the top edge of the cavity, a perimeter rim that inclines downwardly and outwardly from the top tray rim, a handle disposed at an edge of the perimeter rim proximate each end wall, and a leg panel extending downwardly and outwardly from each of a first side and a second side of the perimeter rim proximate the second sloping end wall. The leg panel has a bottom edge that is co-planar with the bottom wall.

20 Claims, 10 Drawing Sheets

U.S. PATENT DOCUMENTS

| | | | |
|---|---|---|---|
| D444,604 | S | 7/2001 | Hoffert et al. |
| 6,622,340 | B2 | 9/2003 | Rosa |
| 6,802,431 | B2 | 10/2004 | Schinkel |
| D524,501 | S | 7/2006 | Prokop et al. |
| D526,748 | S | 8/2006 | Van Skiver |
| 7,083,044 | B1 | 8/2006 | Kilian et al. |
| 7,134,576 | B2 | 11/2006 | Gringer et al. |
| D553,818 | S | 10/2007 | Moon |
| D569,567 | S | 5/2008 | Kohn |
| D571,969 | S | 6/2008 | Byers |
| D586,056 | S | 2/2009 | Shea |
| 2002/0005409 | A1 | 1/2002 | Rose |
| 2004/0134917 | A1 | 7/2004 | Carnegie |
| 2005/0252920 | A1 | 11/2005 | Cumming et al. |
| 2006/0124649 | A1 | 6/2006 | Campbell |
| 2006/0225959 | A1 | 10/2006 | Pohl |
| 2009/0127266 | A1 | 5/2009 | Arvinte et al. |

ERGONOMIC PAINT ROLLER TRAY WITH END HANDLES

CROSS-REFERENCE TO RELATED APPLICATION

This application is a continuation of and hereby incorporates by reference U.S. non-provisional application Ser. No. 12/414,986, filed Mar. 31, 2009 now U.S. Pat. No. 8,162,169, and claims priority from and hereby incorporates by reference U.S. provisional application No. 61/127,347, filed May 12, 2008.

BACKGROUND

Paint trays are generally rectangular and have a sufficiently wide inner tray cavity to receive paint rollers therein. Typical paint roller sizes have nominally tray widths of 18-inch, 9-inch, 6-7-inch and 4-inch. A typical 9-inch paint roller tray will have a useful paint capacity of about a quart of paint. The bottom of the paint tray cavity is typically flat, with three upright sides and a fourth side, which is sloping. This sloping side provides the means for rolling the paint roller down into the paint in the cavity. The roller can then be rolled along the sloping side to remove excess paint from the roller and to evenly distribute paint along the roller prior to its use for applying paint to a target surface. Although the discussion herein will focus on paint, it is understood that paint trays are used for the application of other fluid materials (e.g., another surface coating such as a protectant; an adhesive; a roofing, pavement or driveway coating; a textured surface material, etc.). In a typical paint tray, the sloped side also has a texture pattern formed therein which assists in rotating the paint roller as it is pulled or pushed along that textured side and assists in distribution of the paint across the paint roller. Paint trays for rollers have been formed of such materials as metal and plastic.

SUMMARY

In one aspect, a paint tray comprises a cavity defined by a bottom wall, a first side wall, a second side wall, a first end wall, and a second sloping end wall. Each of the first side wall, second side wall, first end wall, and second sloping end wall inclines upwardly and outwardly from the bottom wall. The cavity terminates at a top edge. The paint tray also comprises a top tray rim adjacent the top edge of the cavity, a perimeter rim that inclines downwardly and outwardly from the top tray rim, a handle disposed at an edge of the perimeter rim proximate each end wall, and a leg panel extending downwardly and outwardly from each of a first side and a second side of the perimeter rim proximate the second sloping end wall. The leg panel has a bottom edge that is co-planar with the bottom wall.

In another aspect, a paint tray liner comprises a cavity defined by a bottom wall, a first side wall, a second side wall, a first end wall, and a second sloping end wall. Each of the first side wall, second side wall, first end wall, and second sloping end wall inclines upwardly and outwardly from the bottom wall. The cavity terminates at a top edge. The paint tray liner also comprises a rim adjacent the top edge of the cavity, wherein the rim comprises a plurality of protrusions.

In yet another aspect, a paint tray system comprises a paint tray and a paint tray liner. The paint tray comprises a first cavity defined by a bottom wall, a first side wall, a second side wall, a first end wall, and a second sloping end wall. Each of the first side wall, second side wall, first end wall, and second sloping end wall inclines upwardly and outwardly from the bottom wall. The first cavity terminates at a top edge. The paint tray also comprises a top tray rim adjacent the top edge of the cavity, a perimeter rim that inclines downwardly and outwardly from the top tray rim, a handle disposed at an edge of the perimeter rim proximate each end wall, and a leg panel extending downwardly and outwardly from each of a first side and a second side of the perimeter rim proximate the second sloping end wall. The leg panel has a bottom edge that is co-planar with the bottom wall. The paint tray liner comprises a second cavity configured to mate with the first cavity. The paint tray liner also comprises a second rim adjacent a top edge of the second cavity, wherein second the rim comprises a plurality of protrusions. The plurality of protrusions of the paint tray liner are configured to mate with the plurality of depressions of the paint tray.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure is referred to by like reference numerals throughout the several views.

Figure 1:
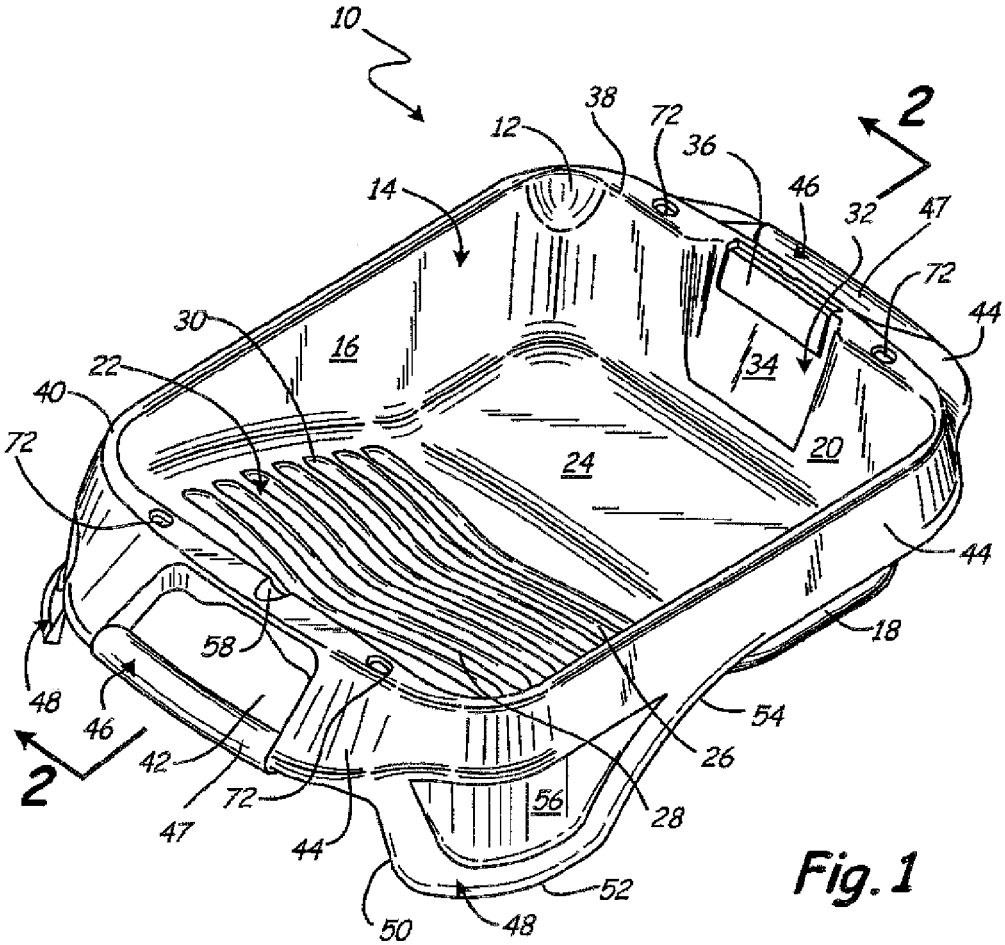
FIG. 1 is a perspective view of a paint roller tray.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. Moreover, where terms such as above, below, over, under, top, bottom, side, right, left, etc., are used, it is to be understood that they are used only for ease of understanding the description. It is contemplated that structures may be otherwise oriented.

DESCRIPTION

A paint roller tray 10 has a fluid cavity 14. One embodiment of tray 10 has an indentation 12 to facilitate pouring a fluid out of cavity 14, thereby increasing pouring accuracy and minimizing dripping. The cavity 14 is formed within side walls 16 and 18 and end walls 20 and 22. The cavity 14 is also defined by a bottom wall 24. In addition, end wall 22 has a first lower section 26 and a second upper section 28.

Figure 2A:
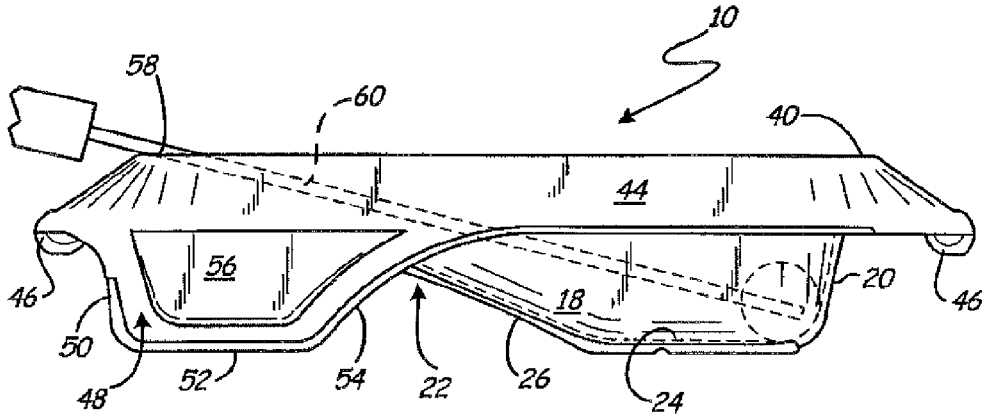
FIG. 2A is a side elevational view of the paint roller tray of FIG. 1.
Figure 2B:
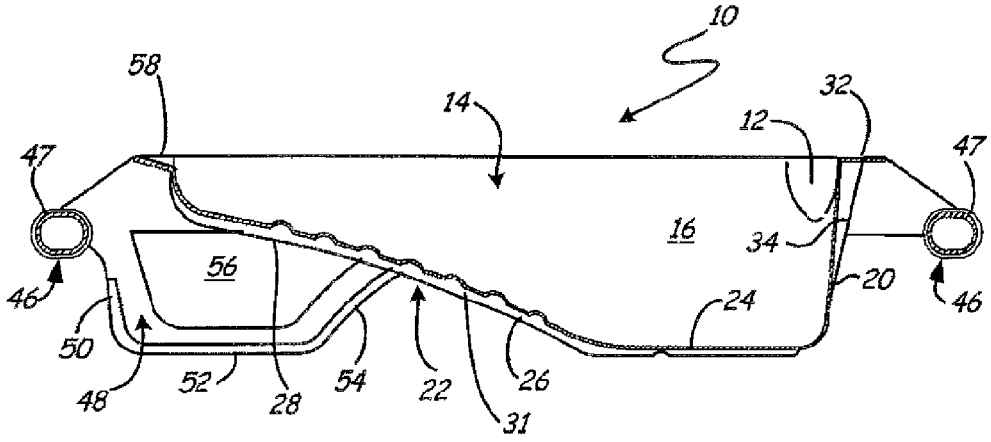
FIG. 2B is a side sectional view of the paint roller tray, taken along line 2-2 of FIG. 1.

FIG. 2A is a side elevational view of the paint roller tray of FIG. 1. FIG. 2B is a side sectional view of the paint roller tray, taken along line 2-2 of FIG. 1. As viewed from the inside of the cavity 14, the first lower section 26 is disposed at an oblique angle relative to the bottom wall 24. The second upper section 28 is disposed at a shallower oblique angle relative to the bottom wall 24. The second upper section 28 serves as a ramp for a paint roller, and is provided with a texture pattern to aid in removing excess paint from the roller as it is rolled across the upper section 28 and to more evenly distribute paint on the roller. In one embodiment, the texture pattern comprises an array of raised elements, such as a pattern of bumps or ridges 30 (that may be straight, curved, and/or generally parallel). Ridges 30 facilitate uniform distribution of paint on a paint roller and also enhance the aesthetic appearance of the tray 10. In an exemplary embodiment, reinforcement fin 31 is disposed on the center line of sloping end wall 22 and bottom wall 24 for added strength and rigidity.

Side walls 16 and 18 and end wall 20, as viewed from the inside of the cavity 14, also taper outwardly away from the bottom wall 24. End wall 20 includes a pocket 32 formed therein which extends outwardly and further increases the volume of the cavity 14. The pocket 32 also tapers outwardly relative to the bottom wall 24. The pocket 32 has a generally planar end wall face 34 with a magnet 36 affixed adjacent a top edge thereof. The pocket 32 thus serves as a retainer, within the cavity 14, for affixing a paint applicator tool having a ferrous-metallic portion thereon (such as a paint brush or roller handle) when that tool is not in use. The magnet 36, in one embodiment, is retained in formed slots in the wall face 34 of the pocket 32. Other means for securing the magnet 36, such as adhesives, are also contemplated. In one embodiment, the pocket 32 as disposed centrally across the end wall 20, although other orientations may be desired.

Because all of the walls defining the cavity 14 slope upwardly and outwardly from the bottom wall 24, the top opening of the cavity 14 is larger than its bottom footprint. A top edge 38 of the cavity 14 extends around each of the end and side walls and defines an inner edge of a planar top tray rim 40. The top tray rim 40 is generally rectangular in outer configuration, with large radius corners between the sides and ends thereof along outer edges thereof. In one embodiment, the top tray rim 40 is generally wider along its ends than along its sides.

Beyond top tray rim 40 (outwardly from the cavity 14), perimeter rim 44 extends downwardly and outwardly therefrom. At each end of roller tray 10, a generally rectangular cutout or open space 42 is provided through the perimeter rim 44. Perimeter rim 44 has a segment that spans cutout 42. That segment of the perimeter rim 44 spanning the cutout 42 thus defines a tray handle 46, with one handle defined at each end of the roller tray 10. Each tray handle 46 may have an additional cover material 47 affixed thereto (either adhered, overmolded or attached by other suitable means) which may facilitate manual gripping of the handle 46.

The tray 10 may be formed of a suitable material (such as polypropylene or other similar plastic) to withstand the harmful effects of paint, stain or varnish, and to provide a durable and generally rigid paint tray structure. In an exemplary embodiment, the bottom, side and ends walls; top tray rim; perimeter rim; handles and leg panels are integrally formed. The materials for an optional cover material 47 for the handle 46 may be of a softer durometer for user comfort and would also be formed to provide enhanced slip resistance. In use, a user would grab each of the handles to transport the tray 10 with paint and or tools therein from one location to another. In one embodiment, the handles 46 are generally parallel.

On each side of the tray 10, depending downwardly from the perimeter rim 44, is a leg panel 48. The leg panel 48 is integrally formed with the tray 10 and serves to stabilize the tray 10 when the tray 10 is placed on a generally horizontal surface. Each leg panel 48 comprises a "fin" of material and has an outer end edge 50 that extends downwardly from the perimeter rim 44 to a bottom edge 52. The bottom edge 52 is generally linear and extends coplanar with the bottom wall 24 of the cavity 14, as seen in FIG. 2A. Near the center of the tray 10, each leg panel 48 has a tapered end edge 54 that extends upwardly from the bottom edge 52 at an oblique angle and ultimately rejoins the perimeter rim 44.

Each leg panel 48 is shaped to provide a stable way to support the end wall 22 when a roller is pressed down thereon, and to prevent the roller tray 10 from tipping toward end wall 22. The bottom edge 52 of leg panel 48 is nearly one quarter of the length of the cavity 12, thus providing an extremely stable footing therefore. Each leg panel 48 has an indented segment 56 therein, which is provided not only to strengthen the leg panel 48, but also for aesthetic purposes.

In one embodiment, the roller tray 10 is approximately 5 inches deep, 15 inches wide and 22 inches long, allowing cavity 14 to hold an entire gallon of paint (weighing approximately ten pounds) while leaving about four inches of the ramp of sloping end wall 22 exposed for roller manipulation.

In an exemplary embodiment, all inner edges of the cavity 14 are rounded to facilitate paint flow and cleanup. In one embodiment, top tray rim 40 has a notch 58 to accept the handle of a paint roller 60 placed in cavity 14, as illustrated in a comparison of FIGS. 1 and 2. Because handles 46 are disposed below top tray rim 40, when a user grips handles 46, the user's hands are spaced from the handle of paint roller 60. This facilitates ease of handling while minimizing unintentional jostling of tools within cavity 14 during movement of roller tray 10. Additionally, the lower center of gravity position of handles 46 allows for better balance when moving roller tray 10. The enhanced ergonomics of this design are particularly important because of the large capacity of cavity 14. Not only is tray 10 relatively large to accommodate a large quantity of paint, but the paint also adds a significant amount of weight to tray 10.

Figure 3:
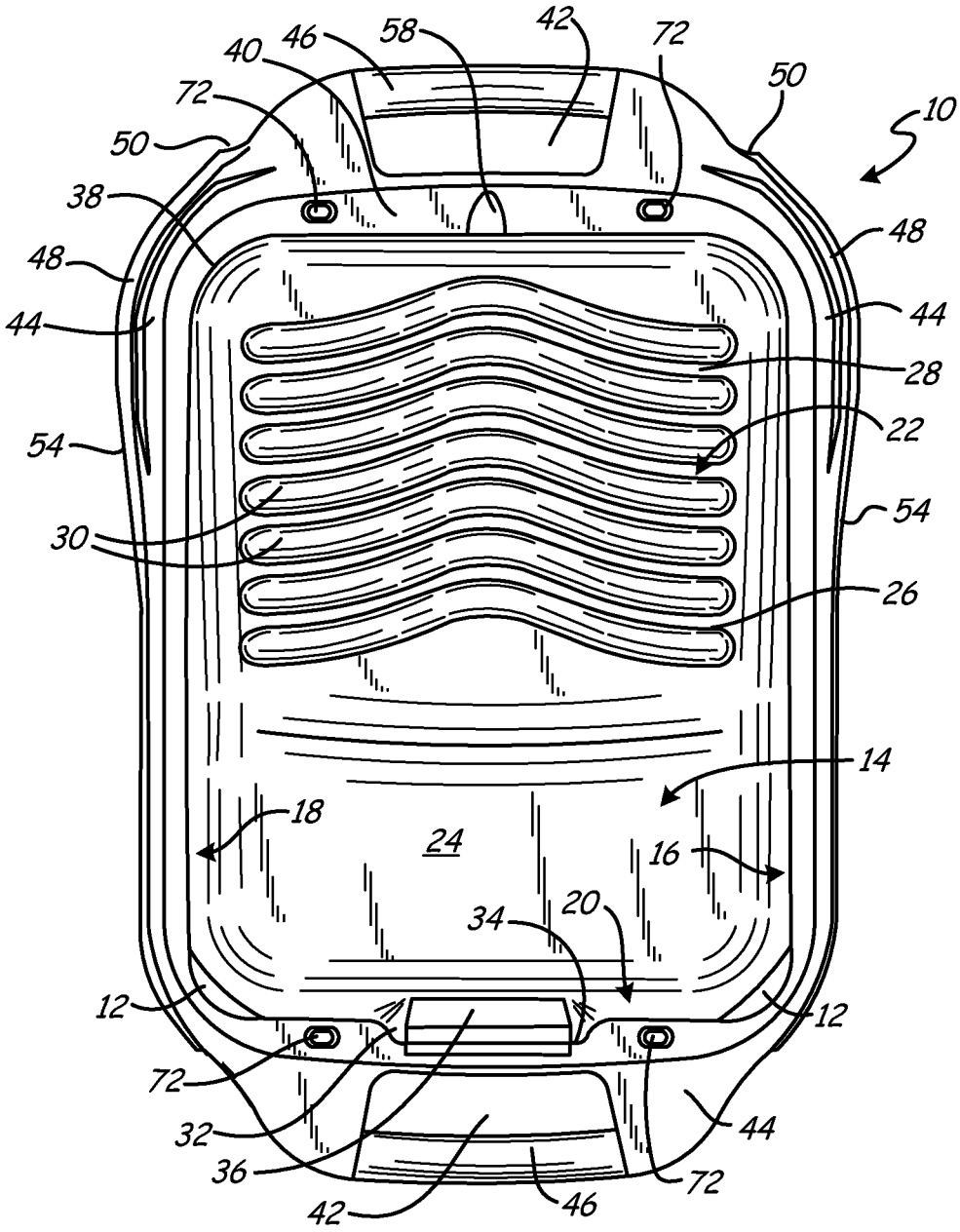
FIG. 3 is a top view of the paint roller tray of FIG. 1.
Figure 4:
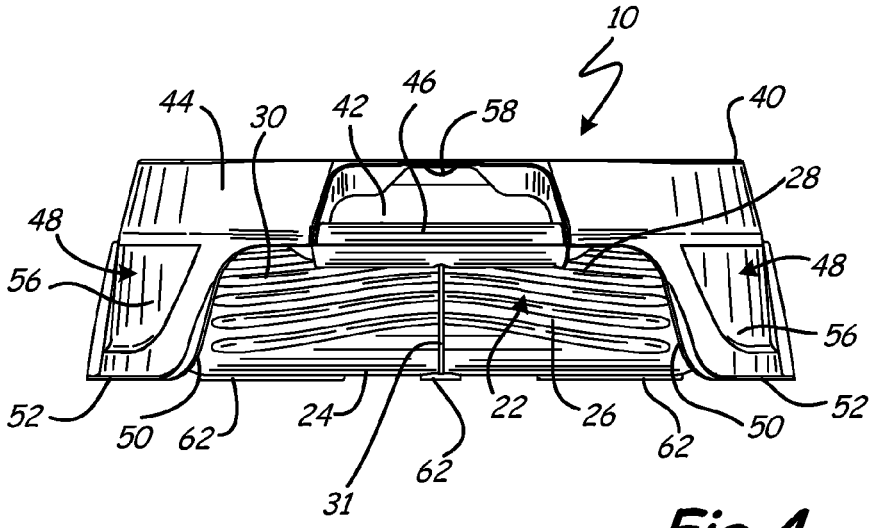
FIG. 4 is an end view of the paint roller tray of FIG. 1, viewed from the end of end wall 22.
Figure 5:
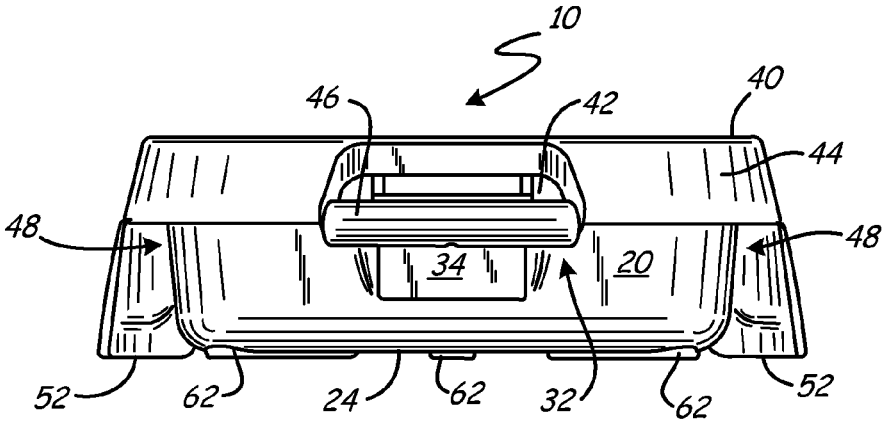
FIG. 5 is an end view of the paint roller tray 10 of FIG. 1, viewed from the end of end wall 20.
Figure 6A:
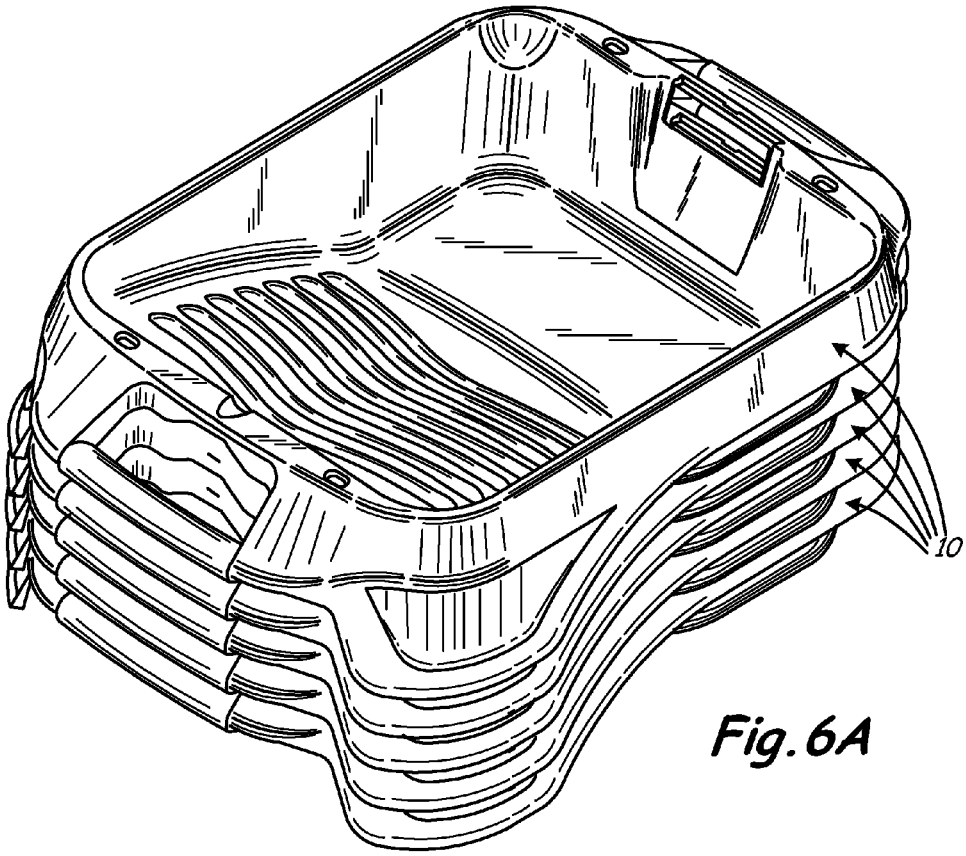
FIG. 6A is a perspective view of a stack of paint roller trays of FIG. 1.
Figure 6B:
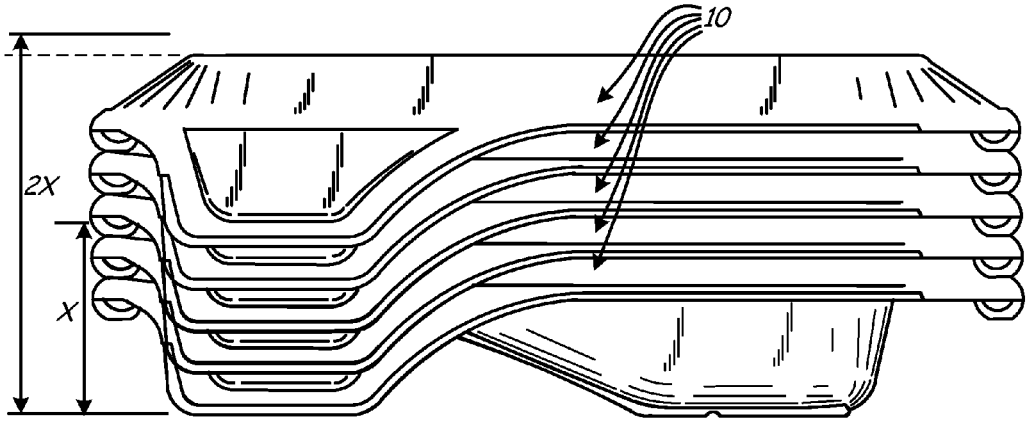
FIG. 6B is a side elevational view of a stack of paint roller trays of FIG. 1.

As seen in FIG. 3, each leg panel 48 flares outwardly from the perimeter rim 44, away from the cavity 14. This flaring outwardly of the leg panels 48, along with the canting of the walls 16, 18, 20 and 22 allows for very efficient "nesting" of the plurality of trays 10, as illustrated in FIGS. 6A and 6B. In an exemplary embodiment, illustrated in FIG. 6B, five roller trays 10 may be stacked in a vertical space that is less than twice the height "X" of a single tray. This provides for very high density storage of a plurality of trays, for shipping and for display purposes at point of sale. FIG. 4 is an end view of roller tray 10, from the end of end wall 22. In an exemplary embodiment, bottom wall 24 includes fins or pads 62 (affixed or formed thereon) to render the exterior of bottom wall 24 flat for stability on a flat surface on which tray 10 is set. In an exemplary embodiment, for weight and materials savings, a pad 62 is not solid but is instead a rim of material that compensates for shape irregularities in bottom wall 24. FIG. 5 is an end view of roller tray 10, from the end of end wall 20.

Figure 7:
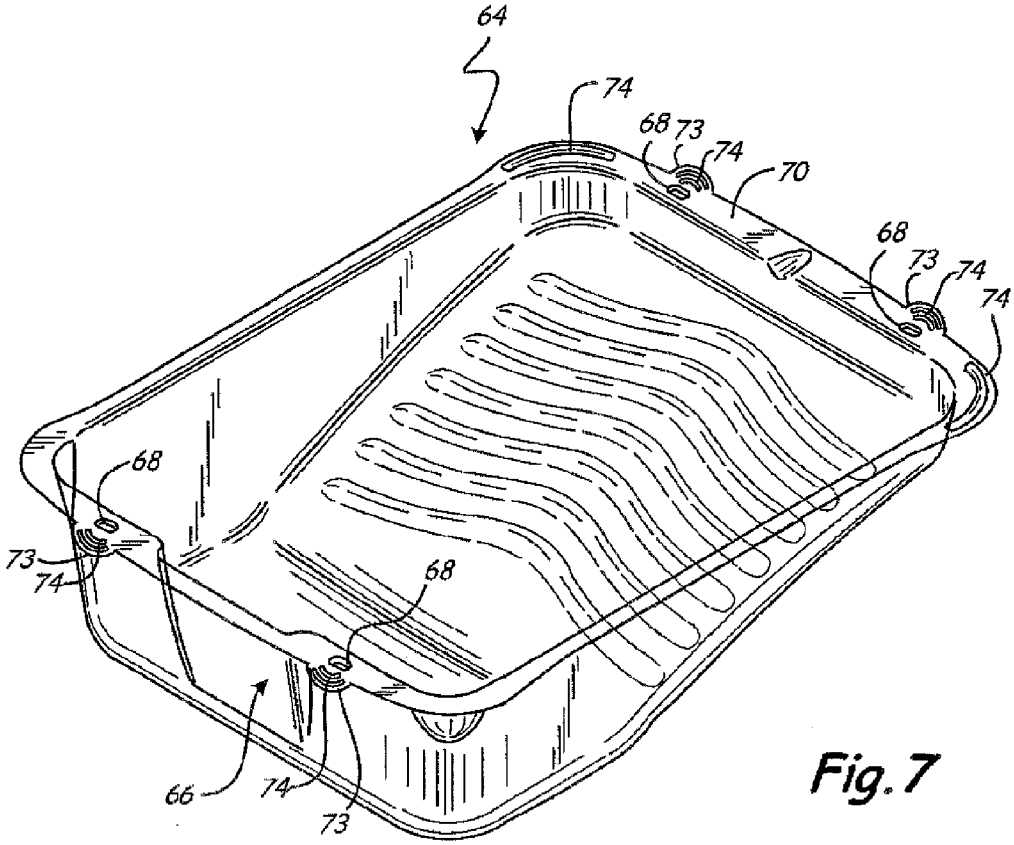
FIG. 7 is a perspective view of a cavity liner designed to fit into a cavity of the paint roller tray of FIG. 1.

As shown in FIG. 7, a cavity liner 64 may also be provided for the tray 10. In one embodiment, the cavity liner 64 is integrally formed from a very thin plastic material (e.g., recycled PET), and is shaped to drop into the cavity 14 of the paint tray 10. The liner 64 is disposable and conforms generally in size and shape to the inner faces of the side walls 16 and 18, bottom wall 24, and end walls 20 and 22 (including the pocket 32 of end wall 20 and the indentation 12 of end wall 20) of roller tray 10. In addition, the liner 64 is made of thin enough material that the magnetic field from magnet 36 extends therethrough and is still useful to hold a ferrous-metallic tool within a pocket area 66 formed thereon (even when the liner 64 has paint thereon).

In an exemplary embodiment, cavity liner 64 has a plurality of protrusions 68 in top rim 70 that are sized and formed to snap into and mate with holes or depressions 72 of top tray rim 40 of roller tray 10 to secure cavity liner 64 within cavity 14 of roller tray 10. In an exemplary embodiment, tabs 73 are disposed proximate protrusions 68 to provide convenient places for gripping liner 64 for removal of protrusions 68 from holes 72. In an exemplary embodiment, cavity liner 64 includes reinforcements 74 on top rim 70 and tabs 73. In an exemplary embodiment, reinforcements 74 are ribs or thicker areas of material provided for additional strength.

As illustrated in FIGS. 7 and 7A, liners 60 may likewise be stacked for shipment, storage and point of sale display. The use of liners 60 thus maximizes the utility of the paint tray 10, and allows for quicker tray cleanup once a painting task has been completed.

Figure 8:
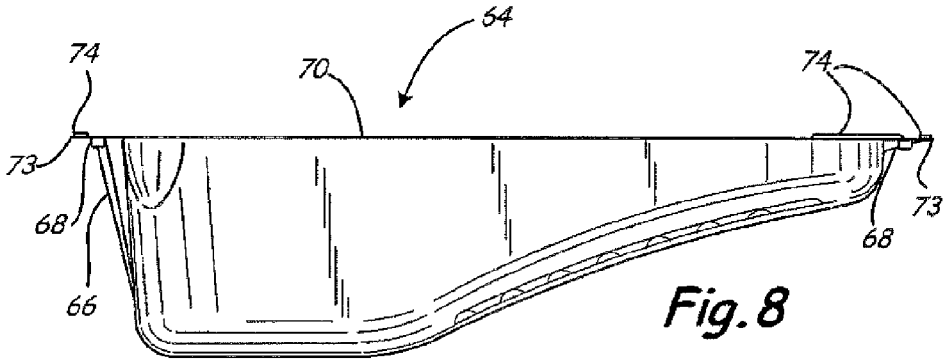
FIG. 8 is a side elevational view of the cavity liner of FIG. 7.
Figure 9:
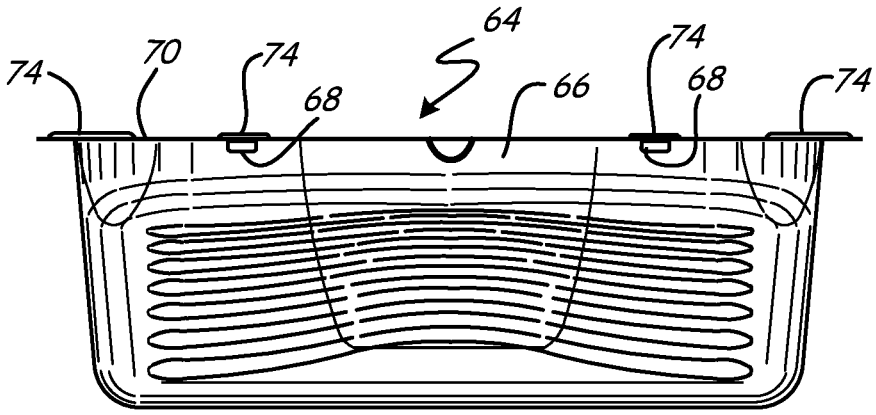
FIG. 9 is an end view of the cavity liner of FIG. 7, viewed from the same perspective as the paint roller tray of FIG. 4 into which the cavity liner fits.
Figure 10:
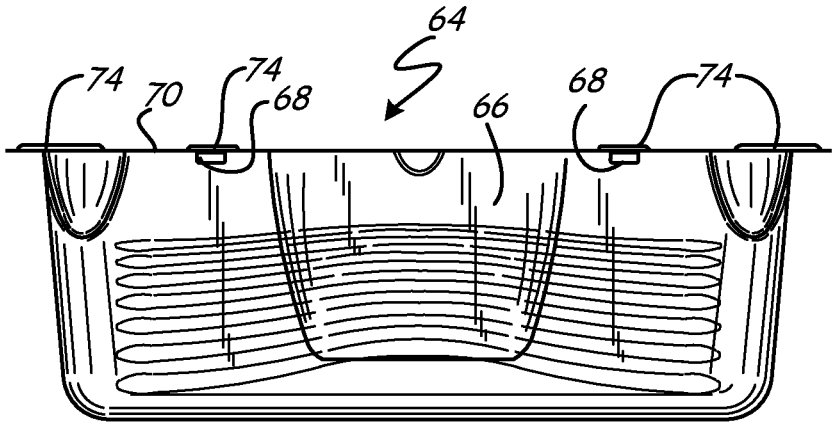
FIG. 10 is an end view of the cavity liner of FIG. 7, viewed from the same perspective as the paint roller tray of FIG. 5 into which the cavity liner fits.
Figure 11:
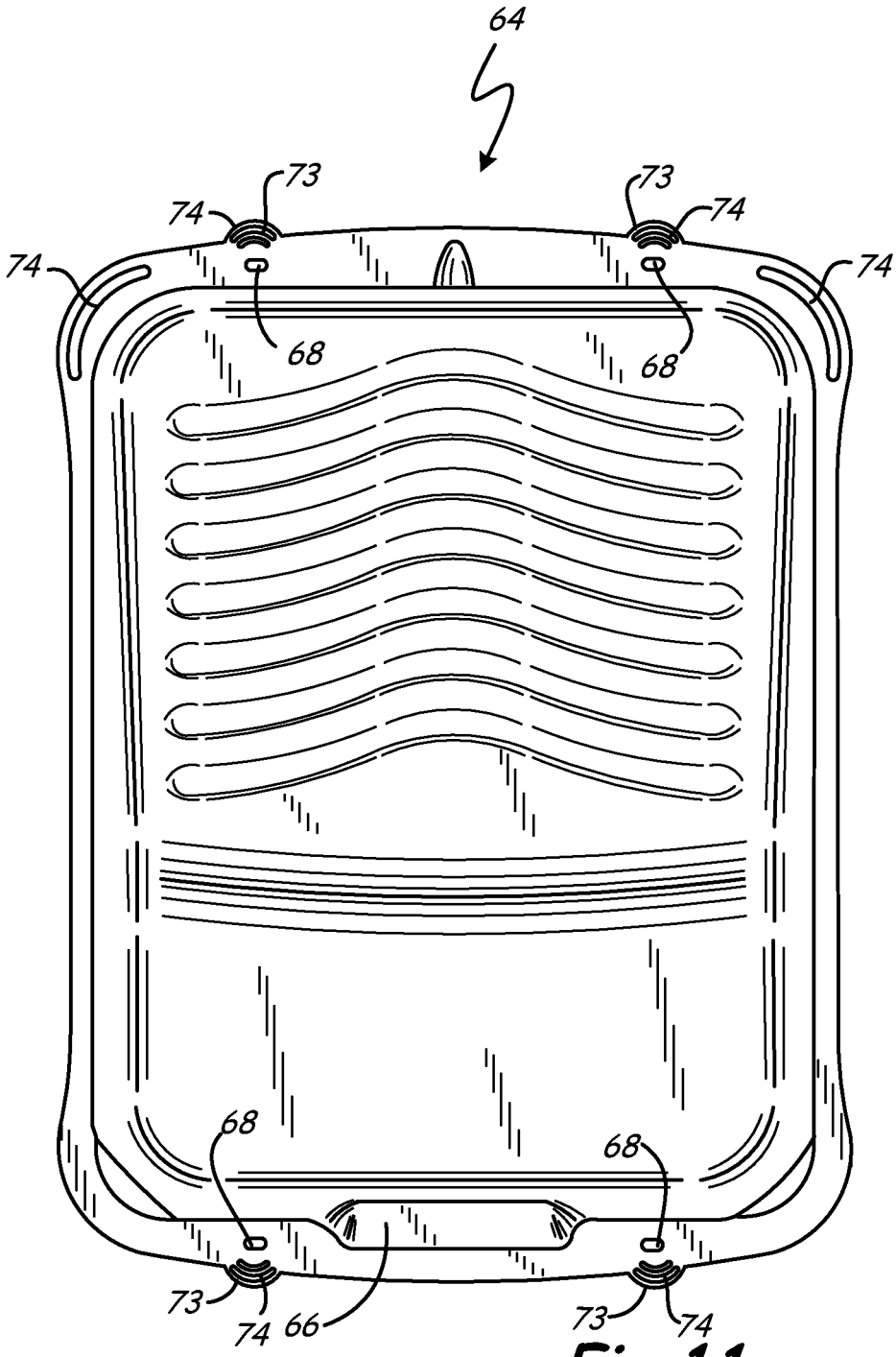
FIG. 11 is a top view of the cavity liner of FIG. 7.
Figure 12A:
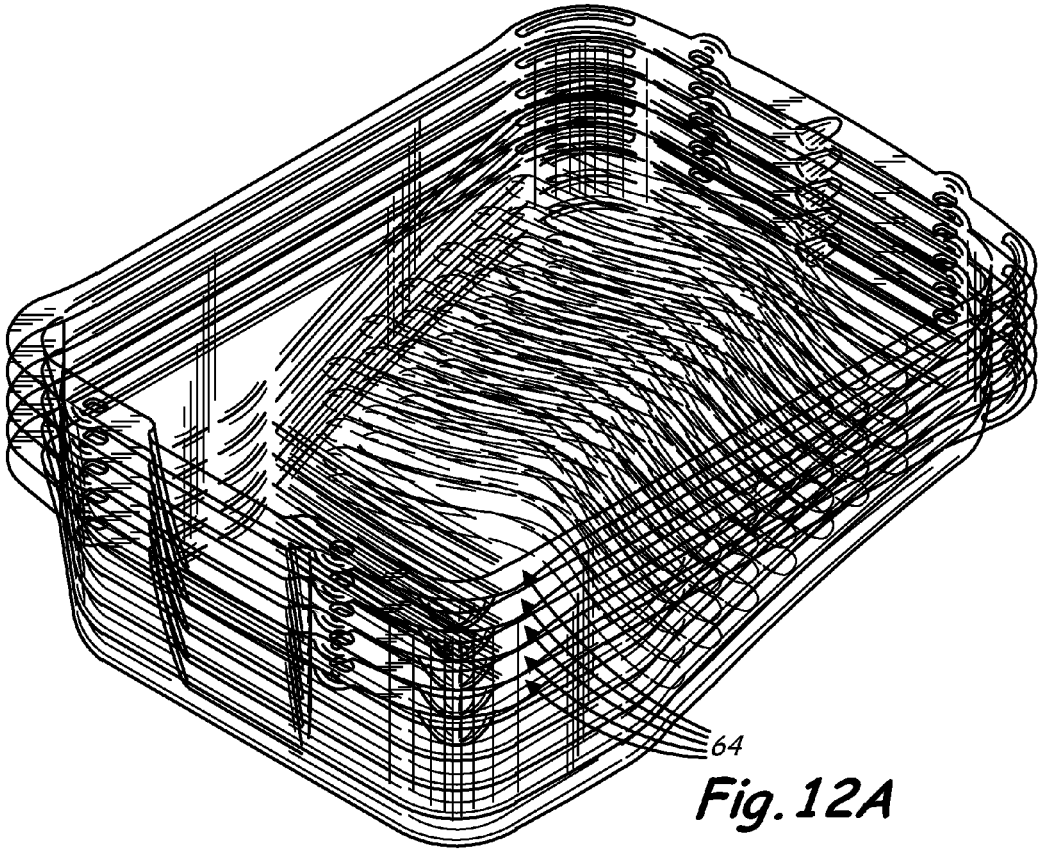
FIG. 12A is a perspective view of a stack of cavity liners of FIG. 7.
Figure 12B:
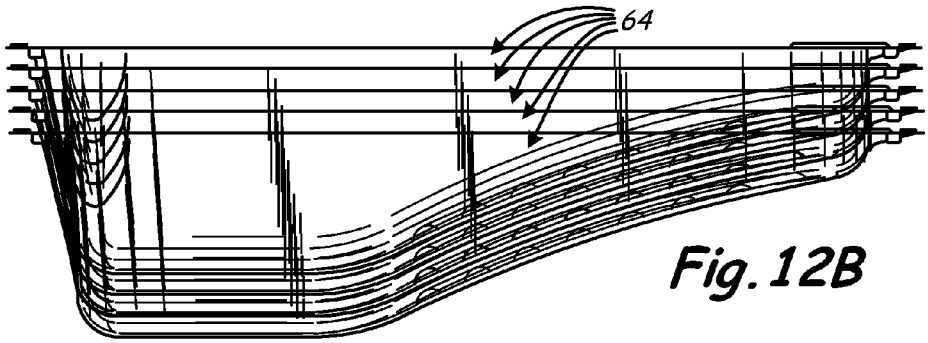
FIG. 12B is a side elevational view of a stack of cavity liners of FIG. 7.
Figure 13:
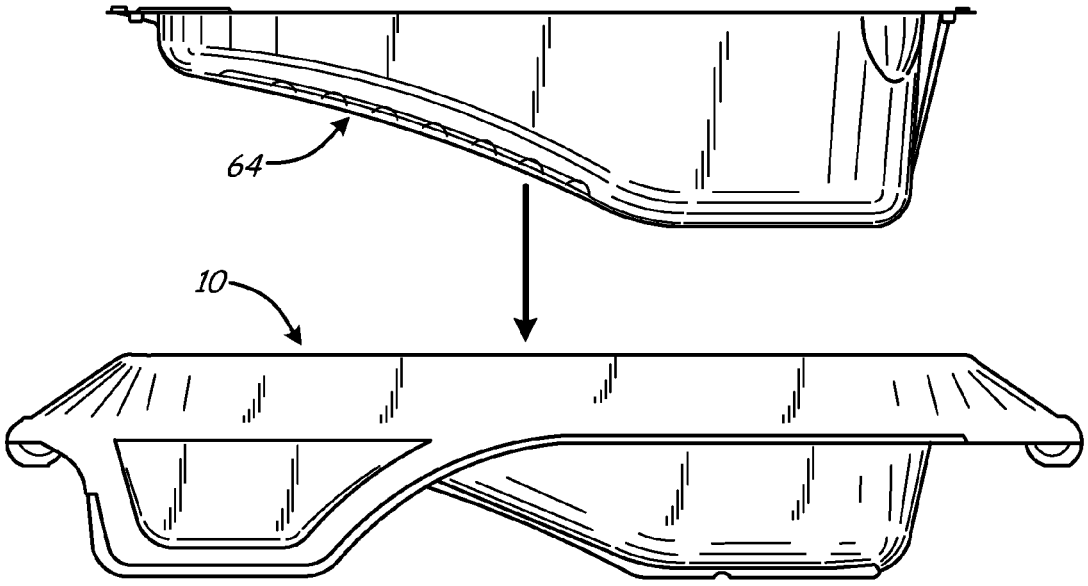
FIG. 13 is a side elevational view of a paint tray system including a paint tray liner of FIG. 7 configured for insertion into a paint tray of FIG. 1.

FIG. 8 is a side elevational view of the cavity liner 64 of FIG. 7. FIG. 9 is an end view of the cavity liner 64 of FIG. 7, viewed from the same perspective as the paint roller tray 10 of FIG. 4 into which the cavity liner 64 fits. FIG. 10 is an end view of the cavity liner 64 of FIG. 7, viewed from the same perspective as the paint roller tray 10 of FIG. 5 into which the cavity liner 64 fits. Because the cavity liner 64 is transparent in an exemplary embodiment, features from both end walls are visible in the views of FIGS. 9 and 10. FIG. 11 is a top view of the cavity liner 64 of FIG. 7. FIG. 12A is a perspective view of a stack of cavity liners 64 of FIG. 7. FIG. 12B is a side elevational view of a stack of cavity liners 64 of FIG. 7. FIG. 13 is a side elevational view of a paint tray system including a paint tray liner of FIG. 7 configured for insertion into a paint tray of FIG. 1. In an exemplary embodiment, the corners of top rim 70 of liner 64 extend beyond the corners of top tray rim 40, thereby allowing for easy removal of liner 64 from roller tray 10.

Although the tray, liner, and tray system for fluid application with roller applicators disclosed herein has been described with respect to several embodiments, workers skilled in the art will recognize that changes may be made in form and detail without departing from the spirit and scope of this disclosure.

What is claimed is:

1. A paint tray comprising:

a cavity defined by a bottom wall and a plurality of walls extending upwardly from the bottom wall, including a first end wall and a second sloping end wall, wherein the cavity terminates at a top edge;

a top tray rim adjacent the top edge;

a perimeter rim that extends downwardly and outwardly from the top tray rim; and a first handle disposed at a lower edge of the perimeter rim, wherein the first handle spans a first opening in the perimeter rim proximate the first end wall, and wherein the first opening is disposed between the first handle and the top tray rim.

2. The paint tray of claim 1 wherein the handle is aligned between the bottom wall and the top edge.

3. The paint tray of claim 1 wherein each wall of the plurality of walls inclines outwardly from the bottom wall.

4. The paint tray of claim 1, and further comprising a first leg panel extending downwardly from the perimeter rim proximate the second end wall, the first leg panel having a bottom edge that is co-planar with the bottom wall.

5. The paint tray of claim 4, and further comprising a second leg panel extending downwardly from the perimeter rim proximate the second end wall, the second leg panel having a bottom edge that is co-planar with the bottom wall, wherein the first leg panel extends from a first side of the perimeter rim and the second leg panel extends from a second side of the perimeter rim.

6. The paint tray of claim 5 wherein the bottom wall comprises a projection on an exterior surface of the bottom wall.

7. The paint tray of claim 1 further comprising a second handle disposed at a lower edge of the perimeter rim, wherein the second handle spans a second opening in the perimeter rim proximate the second end wall, and wherein the second opening is disposed between the second handle and the top tray rim, wherein the first handle and the second handle are generally parallel.

8. The paint tray of claim 1 wherein the handle comprises a cover.

9. The paint tray of claim 1 wherein the second end wall forms a ramp between the bottom wall and the top edge.

10. The paint tray of claim 9 wherein the ramp has a first lower section and a second upper section, wherein the first lower section is disposed at a first oblique angle relative to the bottom wall, and wherein the second upper section is disposed at a second oblique angle relative to the bottom wall, wherein the second oblique angle is shallower than the first oblique angle.

11. The paint tray of claim 9, and further comprising a texture pattern on the ramp.

12. The paint tray of claim 11 wherein the texture pattern comprises a plurality of ridges.

13. The paint tray of claim 1 wherein the first wall comprises a pocket.

14. The paint tray of claim 13 wherein the pocket comprises a magnet.

15. The paint tray of claim 1 wherein the top tray rim comprises a plurality of depressions.

16. A paint tray system comprising:

a paint tray comprising:

a first cavity defined by a bottom wall and a plurality of walls extending upwardly from the bottom wall, including a first end wall and a second sloping end wall, wherein the first cavity terminates at a top edge;

a top tray rim adjacent the top edge of the cavity, wherein the top tray rim comprises a plurality of depressions;

a perimeter rim that extends downwardly and outwardly from the top tray rim;

a first handle disposed at a lower edge of the perimeter rim, wherein the first handle spans a first opening in the perimeter rim proximate the first end wall, and wherein the first opening is disposed between the first handle and the top tray rim; and a leg panel extending downwardly from the perimeter rim proximate the second end wall, wherein the leg panel has a bottom edge that is co-planar with the bottom wall; and a paint tray liner comprising:

a second cavity configured to mate with the first cavity; and a top rim adjacent a top edge of the second cavity, wherein the top rim comprises a plurality of protrusions, wherein the plurality of protrusions of the paint tray liner are configured to mate with the plurality of depressions of the paint tray.

17. The paint tray of claim 16 wherein the bottom wall comprises a projection on an exterior surface of the bottom wall.

18. The paint tray of claim 16 wherein the handle is aligned between the bottom wall and the top edge.

19. The paint tray of claim 16 further comprising a second handle disposed at a lower edge of the perimeter rim, wherein the second handle spans a second opening in the perimeter rim proximate the second end wall, and wherein the second opening is disposed between the second handle and the top tray rim, wherein the first handle and the second handle are generally parallel.

20. The paint tray of claim 16 wherein one of the plurality of walls comprises a magnet.

* * * * *